US006902432B2

(12) United States Patent
Morikawa et al.

(10) Patent No.: US 6,902,432 B2
(45) Date of Patent: Jun. 7, 2005

(54) USB CONNECTOR

(75) Inventors: Taishi Morikawa, Haibara-gun (JP); Fumio Narui, Yokohama (JP); Shinichi Ikemoto, Yokohama (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/361,489

(22) Filed: Feb. 11, 2003

(65) Prior Publication Data

US 2003/0157836 A1 Aug. 21, 2003

(30) Foreign Application Priority Data

Feb. 21, 2002 (JP) ..... P2002-044472

(51) Int. Cl.[7] ..... H01R 13/648
(52) U.S. Cl. ..... 439/607; 439/358
(58) Field of Search ..... 439/607, 352, 439/353, 372, 358, 596, 595, 610, 387, 676, 677, 923, 660

(56) References Cited

U.S. PATENT DOCUMENTS 5,865,646 A * 2/1999 Ortega et al. ..... 439/607
6,056,578 A * 5/2000 Lin ..... 439/358
6,234,827 B1 * 5/2001 Nishio et al. ..... 439/357
6,358,088 B1 * 3/2002 Nishio et al. ..... 439/596
6,508,678 B1 * 1/2003 Yang ..... 439/677

FOREIGN PATENT DOCUMENTS

JP 2000-223218 8/2000

* cited by examiner

*Primary Examiner*—Gary Paumen
*Assistant Examiner*—Edwin A. Leon
(74) *Attorney, Agent, or Firm*—Sughrue Mion, PLLC

(57) ABSTRACT

A USB connector includes a jack and a plug. The jack includes a shield shell, having jack terminals therein. The plug includes a shield case, having plug terminals to be electrically connected to the jack terminals, and fitted into the shield shell. The shield shell has a mating portion The shield case has a latching portion which engages with the mating portion when the plug is inserted into the jack.

6 Claims, 5 Drawing Sheets

10... USB CONNECTOR
15... JACK
16... SHIELD SHELL
20... GROOVE (MATING PORTION)
40... PLUG
41... SHIELD CASE
50... FLEXIBLE PIECE (LATCHING PORTION)
51... CLAW
59... RIB

USB CONNECTOR

BACKGROUND OF THE INVENTION

The present invention relates to a USB connector having a lock mechanism and used for electrically connecting the body of a computer such as a personal computer or a workstation and peripheral equipment including a mouse, a keyboard and so on.

Recently, a mouse, a keyboard, a printer, a scanner, a modem, an external memory and the like as peripheral equipment are connected to one computer body via different interfaces. For example, a mouse and a keyboard are connected to different serial interfaces for making serial transfer; a printer and a scanner to different parallel interfaces for making parallel transfer; a modem to an RS-232C for making serial transfer; and an external memory to an SCSI interface for making parallel transfer. Moreover, an interface with the same item of peripheral equipment may vary with the computer or equipment manufacturer.

The existence of different interfaces as described above makes it difficult to set computer bodies compatible with any peripheral equipment or integrate the computer body with the peripheral equipment; the problem is that there develops inconvenience in handling computers and peripheral equipment, thus increasing the manufacturing cost. In order to solve the problem, a USB (Universal Serial Bus) interface for use in integrating various interfaces has entered the computer field. Further, it takes on a new aspect that Mini-B interfaces for small-sized peripheral equipment including digital cameras and portable music players are to be added to USB interfaces.

Although the USB interface is a serial interface for making serial transfer, its transmission speed is by far improved in comparison with that of the related serial interface and is advantageous in that the USB interface is capable of simply connecting the computer body and the peripheral equipment at lower cost. Moreover, new cable connectors are being provided so as to conform to new interfaces like this.

FIG. 5 shows a USB connector conforming to such a USB interface as described in JP-A-2000-223218 by way of example. A USB connector 100 has a jack 101 to be directly attached to a printed circuit board (not shown) with electronic devices including transistors and capacitors mounted thereon or to a printed circuit board (not shown) without electronic devices mounted thereon but with only a wiring conductor formed thereon and a plug 120 that is inserted into the jack 101. When the plug 120 and the jack 101 are fitted together a computer body (not shown) and peripheral equipment (not shown) are electrically connected together.

The jack 101 has a shield shell 102 formed by bending a conductive board and an insulating plastic portion 115 with a plurality of jack terminals 110 fixed thereto inside the shield shell 102. Each jack terminal 110 has an elastic contact portion 111 in one side end portion and an external directly-attached type terminal portion 112 in the other side end portion, the jack terminal 110 being elbow-shaped. The jack terminal 110 is such that a substantially intermediate portion between the elastic contact portion 111 and the external directly-attached type terminal portion 112 is fixed to the plastic portion 115 and that the bent front end of the elastic contact portion 111 mates with the front end portion of the plastic portion 115 and is elastically held therein.

A mating space 103 for receiving the opposite plug 120 is formed inside the wall portion of the shield shell 102. A mounting leg portion 104 extending vertically downward is formed on a base wall 102*b*. The mounting leg portion 104 is fixed by solder to the circuit board (not shown).

The plug 120 inserted into the jack 101 has a plastic housing 121 and a cylindrical shield case 122 that is held in the housing 121. The mating portion 123 of the shield case 122 fitted into the shield shell 102 is projected from the housing 121 and the base portion 124 of the shield case 122 is provided in a buried condition. A terminal holding portion 137 with plug terminals 130 fixed thereto and an insertion space 136 for receiving the plastic portion 115 of the jack 101 are formed inside the mating portion 123.

Each plug terminal 130 is formed with an electrical contact portion 131 for making contact with the elastic contact portion 111 of the jack terminal 110 in one side end portion and with an electrical-wire connecting portion (not shown) in the other end portion, the plug terminal 130 being held straightly. The electrical contact portion 131 is fixed onto the top face of the terminal holding portion 137 and the electrical-wire connecting portion is connected to an electrical wire (not shown) located in the inner part of the housing 121.

However, the related USB connector involves the following problems. Even while the jack 101 and the plug 120 are connected in a latched condition, there is still fear of causing the plug 120 to come off the jack 101 when vibration or external force is applied to them. This latching structure is arranged so that the latching operation is performed by fitting opposed lock pieces 105 provided in the upper wall 102*a* and the base wall 102*b* of the shield shell 102 respectively into hole portions 125 provided in the upper wall 122*a* and the base wall 122*b* of the shield case 122. As each lock piece 105 is shaped like a V having an inclined plane on both sides, its latching force is weak and when vibration or external force inadvertently acts on either jack 101 or plug 120, the hole portion 125 may slide along the inclined plane 105*a* on one side of the lock piece 15 whereby to release the latching of the plug 120.

On the other hand, in case that the elastic force of the lock pieces 105 is strengthened in order to prevent the plug 120 from easily slipping off the jack 101, another problem arises in that the plug 120 will not pulled out even by giving the plug 120 a jerk. In a word, the elastic force of the lock pieces 105 is difficult to adjust; the latching of the lock pieces 105 is released inadvertently when it is unnecessary to release the latching thereof or conversely cannot be released when it is necessary to do so.

In addition, because the opposed lock pieces 105 are provided in the opposed wall portions 102*a* and 102*b* respectively, the shield shell 102 has no slide guide face for use when the shield case 122 is slidably fitted in and the vertical positioning of the plug 120 is not carried out, so that it is feared that backlash is produced in the vertical direction.

Further, though it has been arranged to keep the jack 101 and the plug 120 in the latched condition by dropping the lock pieces 105 into the hole portions 125, the latched condition lacks the click feeling of restraint and despite the fact that the plug 120 is not connected to the jack 101 in a completely latched condition, it is likely that the latched condition is mistaken for an achieved latched condition.

SUMMARY OF THE INVENTION

It is therefore an object of the present invention to provide a USB connector, which restrains a plug and a jack from being loosely latched together in order to prevent the plug from slipping off the jack even when vibration or external force is applied thereto and easily releases the latching of the plug as the need arises, so that an excellent fitting property is provided.

In order to achieve the above object, according to the present invention, there is provided a USB connector comprising:

a jack, including;

a shield shell, having jack terminals therein; and a plug, including;

a shield case, having plug terminals to be electrically connected to the jack terminals, and fitted into the shield shell, wherein the shield shell has a mating portion;

wherein the shield case has a latching portion which engages with the mating portion when the plug is inserted into the jack.

In the above configuration, the shield case is slidably fitted into the shield shell when the plug is inserted into the jack and the jack terminals and the plug terminals electrically contact and moreover a computer body and the peripheral equipment are connected with the contact portion shielded. As the shield case is provided with the latching portions and as the shield shell is provided with mating portions, the latching portions and the mating portions are engaged together so that the jack and the plug are latched together without looseness, whereby the plug is prevented from slipping off the jack because of vibration or external force inadvertently applied thereto. Therefore, the latching is certainly by far improved.

Preferably, the latching portion is a deformable piece having a claw at the front end, and the deformable piece being provided in the shield case and extending in a direction in which the plug is inserted into the jack.

Here, it is preferable that, the deformable piece is a pair of deformable pieces.

In the above configuration, since latching portion is the deformable piece having the claw at the front end, the claws mate with the mating portions to ensure the latching of the plug when the plug is inserted into the jack. The latching portions are provided in the one wall portion and as no lock pieces are provided in the opposed walls of the shield shell like the related example, the outer wall face of the shield case is guided and supported by the inner wall face of the shield shell when the plug is inserted into the jack, whereby the plug stably mates with the jack without prying open the jack. As the pair of latching portions are provided, further, the lateral balance is improved and the insertion is smoothly carried out with the effect of ensuring the latching further. Therefore, the effect of ensuring the latching further is achievable and the plug is smoothly fitted into the jack, so that an excellent fitting property is provided.

Preferably, a shield contact piece for making contact with the shield case is provided in a wall portion of the shield shell, and a groove formed between the shield contact pieces and the one wall portion forms the mating portion.

Here it is preferable that, the shield contact piece is a pair of shield contact pieces, and the groove is a pair of grooves.

In the above configuration, as the grooves formed between the shield contact pieces and the one wall portion form the mating portions, it is unnecessary to newly form hole portions with which the lock pieces mate as in the related example, whereby the connector can be equipped with lock means without increasing the number of processing steps.

Here it is preferable that, the USB connector further comprising a housing which holds the shield case therein; and a push member, which is pivotably coupled to the housing, and having a projection which is brought into contact with the deformable piece to release the engagement between the shield shell and the shield case.

In the above configuration, the projection is brought into contact with the deformable pieces by pushing the push member when the plug is pulled out of the jack and the deformable pieces are bent in the direction in which the latching is released with the claws slipped off the grooves, whereby the plug is easily removed from the jack. Therefore, the plug is easily removed from the jack and this improves the property of releasing the latching.

Here it is preferable that, ribs positioned on both sides of the push member are provided on the housing, and a height of the ribs protruded outward is equal to and greater than that of the push member.

In the above configuration, the provision of the projections in the wall portion of the housing prevents the push member from being inadvertently pressed because of interference with the outside, so that the plug is prevented from slipping off the jack. Therefore, the latching reliability is secured even when the push member as a latch-releasing member is provided.

BRIEF DESCRIPTION OF THE DRAWINGS

The above objects and advantages of the present invention will become more apparent by describing in detail preferred exemplary embodiments thereof with reference to the accompanying drawings, wherein:

FIG. 2A is a plan view of the jack; FIG. 2B is a right side view of the jack; and FIG. 2C is a sectional view taken on line A—A of FIG. 2A;

FIG. 3A is a plan view of the plug; FIG. 3B is a left side view of the plug; and FIG. 3C is a sectional view taken on line B—B of FIG. 3A;

FIG. 4A is a plan view of the USB connector; and FIG. 4B is a sectional view taken on line C—C of FIG. 4A.

DETAILED DESCRIPTION OF THE PREFERRED EMBODIMENTS

A detailed description will now be given of a preferred embodiment of the invention by reference to the drawings. FIGS. 1 to 4 show a USB connector of a embodiment according to the invention.

Figure 1:
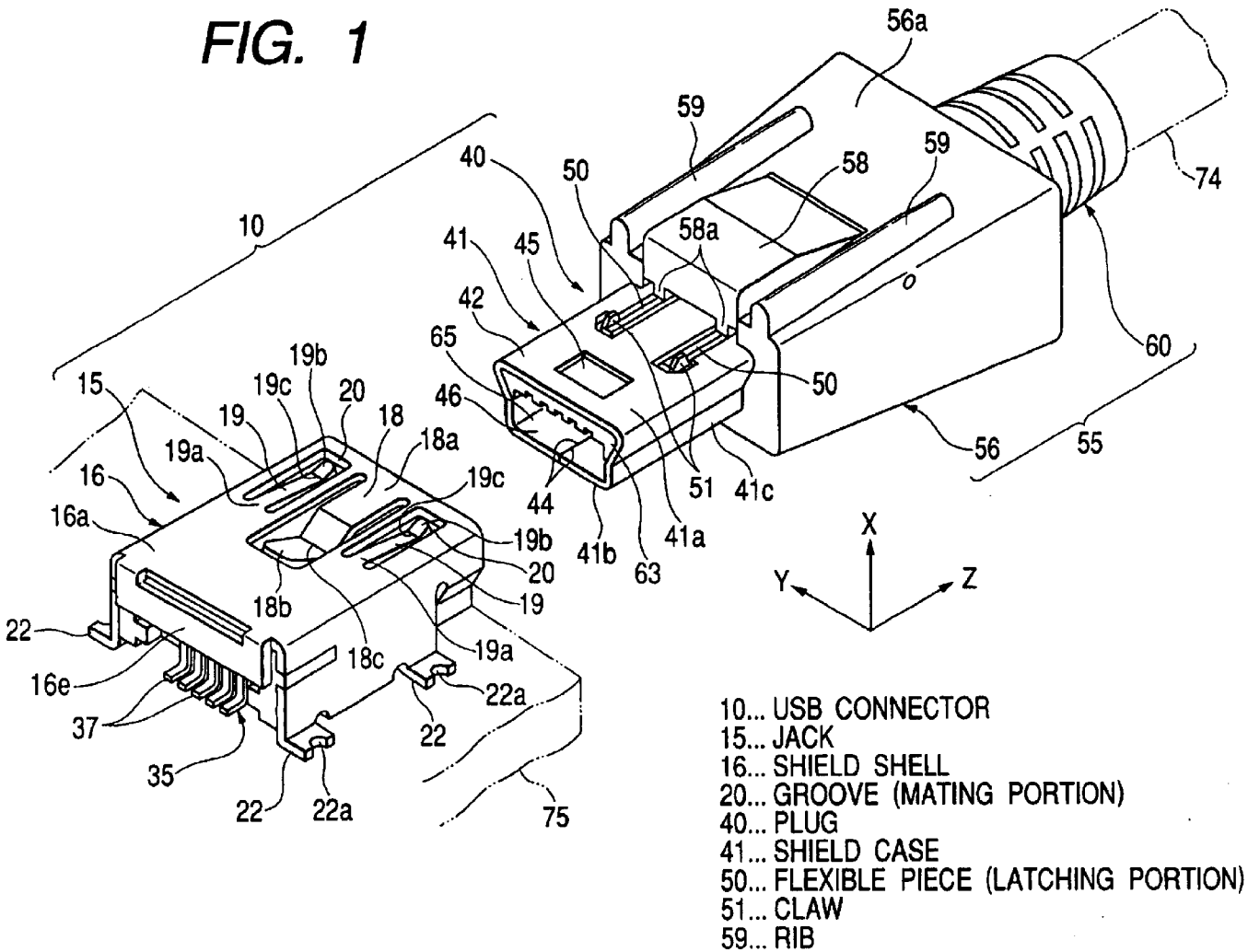
FIG. 1 shows a perspective view of a USB connector according to the invention.

A USB connector 10 of FIG. 1 is a cable connector conforming to the USB interface standard and mainly used for connecting a computer body (not shown) and peripheral equipment (not shown).

A USB connector 10 has a jack 15 fixed to a circuit board 75 such as a printed circuit board and a printed wiring board and a plug 40 provided on the peripheral equipment (not shown) side and used for setting up an electrical connection by mating with the jack 15. The jack 15 is fixed to the circuit board 75 by means of a fastening member or solder and the plug 40 is connected to the terminal portion of an electrical wire 74 drawn from the peripheral equipment. The jack 15 and the plug 40 of the USB connector 10 connected together will successively be described hereafter.

The jack 15 is a connecting part on one side of the USB connector 10. The jack 15 is formed with a cover-like shield shell 16 and a plastic portion 30 (see FIG. 2) to which jack terminals 35 are fixed. The shield shell 16 is formed by punching from a conductive sheet of copper, copper alloy or aluminum alloy and bending the punched part. The plastic portion 30 is an insulating integrally molded part by injection molding using synthetic resin like propylene.

The base portion of the shield shell 16 is formed with a rectangular upper wall 16*a*, a base wall 16*b* (see FIG. 2) facing the upper wall 16*a*, side walls 16*c* for linking the edge portions of the upper wall 16*a* and the base wall 16*b*, a front wall 16*d* (see FIG. 2) having an opening 23 and a rear wall 16*e* from which an external directly-attached type terminal portion 37 (see FIG. 2) formed at the rear end of each jack terminal 35 is drawn. An internal space where the plastic portion 30 is incorporated is formed inside the wall portion.

For convenience of explanation of the invention, the vertical direction (the direction of height) X, the lateral direction (the direction of width) Y and the longitudinal direction (the longer direction) Z will be defined as follows (see FIG. 1). The vertical direction X is designated a direction in which flexible pieces (latching portions) 50 are bent and in this case, upward means the side on which the flexible pieces 50 are positioned and downward means the side on which the jack 15 is fixed to the circuit board 75. The lateral direction is designated a direction in which the pair of flexible pieces 50 are arranged; however, right and left are not distinguished from each other because of bilateral symmetry. The longitudinal direction is designated a direction in which the jack 15 and the plug 40 mate with each other and the front means the side where the jack 15 and the plug 40 face each other.

As shown in FIG. 1, the upper wall 16*a* is flat and a cantilever tongue piece 18 is provided in the central portion of the upper wall 16*a*, the central portion thereof being positioned close to the front wall 16*d*. Cantilever shield contact pieces 19 are provided on both sides of the tongue piece 18 in the width direction Y. Each shield contact piece 19 has a width approximately half the width of the tongue piece 18 and a length shorter than that of the tongue piece 18.

The tongue piece 18 has a base portion 18*a* linked with the side of the front wall 16*d* of the upper wall 16*a* and a free end portion 18*b* extending rearward from the base portion 18*a* in the longer direction Z. On the front end side of the free end portion 18*b*, a curved portion 18*c* projecting inside the shield shell 16. Consequently, the tongue piece 18 is allowed to bend with the base portion 18*a* as a fulcrum. When an opposite shield case 41 enters an insertion space 25 (see FIG. 3), the curved portion 18*c* is pressed against the shield case 41 and caused to rise once outside the shield shell 16 so as to mate with the depression 45 of the shield case 41, whereby the primary latching is carried out.

Each shield contact piece 19 is formed so that the directions of the base portion 19*a* and the free end portion 19*b* are set opposite in direction to the tongue piece 18. More specifically, the base portion 19*a* is linked with the substantially central side of the side wall 16*c* of the upper wall 16*a* and the free end portion 19*b* is extended forward in the longer direction Z. Like the tongue piece 18, a curved portion 19*c* is formed on the front end side of the free end portion 19*b*. Like the tongue piece 18, the shield contact piece 19 is also allowed to bend with the base portion 19*a* as a fulcrum. When the plug 40 is inserted into the jack 15, the curved portions 19*c* are brought into contact with the upper wall 41*a* of the shield case 41, and the shield shell 16 and the shield case 41 are connected together in a shielded condition, so that the whole USB connector 10 is shielded.

Each of the U-shaped grooves 20 is formed by punching along the ridge line of the shield contact piece 19 between the shield contact piece 19 and the upper wall 16*a*. The groove 20 positioned on the front end side of the shield contact piece 19 serves as a mating portion with which the claw 51 of the flexible piece 50 formed in the shield case 41 mates. The jack 15 and the plug 40 are thus latched together secondarily by mating the claws 51 with the grooves 20.

The base wall 16*b* (see FIG. 2B) is a wall facing the circuit board 75 and integrally formed by butting both end portions 21 and 21 (see FIG. 2B) of a bent conductive sheet against each other and engaging together barrel portions (not shown) formed in both end portions 21 and 21. When the jack 15 is fixed to the circuit board 75, the base wall 16*b* is fixed in such a condition as to be slightly raised from the board face. This is because unless the base wall 16*b* is in the slightly raised condition, the wiring conductor (not shown) of the circuit board 75 is short-circuited.

The side walls 16*c* on both sides are formed so as to intersect the upper wall 16*a* and the base wall 16*b* substantially at right angles. Although each of the side walls 16*c* has a substantially flat face, a mounting leg portion 22 is formed in the lower part of and along the ridge line of the side wall 16*c*. The mounting face of the mounting leg portion 22 is projected downward so that it is positioned lower than the base wall 16*b*, whereby the base wall 16*b* is not brought in direct contact with the circuit board 75. In the end portion of the mounting leg portion 22, a semi-arcuate cutout portion 22*a* for receiving a fastening member such as a bolt (not shown) is formed. Two of the mounting leg portions 22 are provided on both side walls 16*c* and with four fastening members in total, the jack 15 is fixed to the circuit board 75. In this case, the mounting leg portions 22 may be fixed thereto by brazing such as soldering.

The front wall 16*d* (FIG. 2B) has the opening for receiving the shield case 41 into the mating space 25 of the shield shell 16. The opening 23 has an upper half portion and a lower half portion that are different in width and the width of the lower half portion is narrower than that of the upper half portion. The reason for the formation of the upper and lower half portions different in width is to prevent the plug 40 from being fitted in upside down by mistake.

Figure 2A:
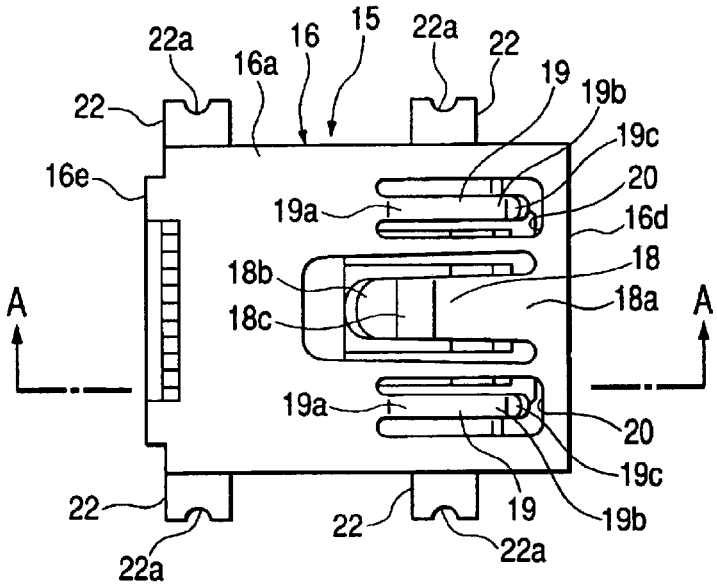
FIGS. 2A, 2B, and 2C show a diagram of a jack for use in forming the USB connector of FIG. 1.
Figure 2B:
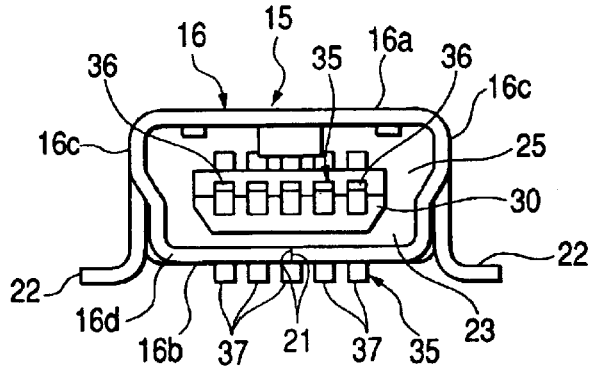
Figure 2C:
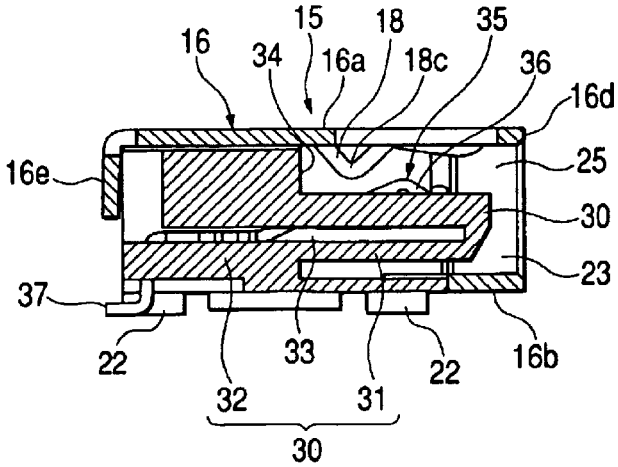

As shown in FIG. 2C, the height of the rear wall 16*e* is substantially half the height of the side walls 16*c* (see FIG. 2B). Therefore, the lower half portion of the rear wall 16*e* is kept open and this is because the external directly-attached type terminal portions 37 are connected to the circuit board 75 (see FIG. 1) by exposing the external directly-attached type terminal portions 75 to the outside through the open space in the lower half portion thereof.

The plastic portion 30 (see FIG. 2C) in which the jack terminals 35 are secured is made of insulating synthetic resin. The plastic portion 30 has a front portion 31 for supporting the elastic contact portion 36 of each jack terminal 35 and a rear portion 32 continuously positioned in the rear of the front portion 31 and used for supporting the external directly-attached type terminal portion 37 of the jack terminal 35. The front portion 31 is formed with the annular mating space 25 (see FIG. 2B) left inside the shield shell 16. The rear portion 32 is formed into what has the same internal dimension as that of the shield shell 16 so that the rear portion 32 can be fixedly stuck to the inner wall of the shield shell 16 without any space. The front wall of the rear portion 32 functions as a stopper wall 34 with respect to the front end of a terminal holding portion 63 (see FIG. 3C) which will be described later.

A through-hole 33 for passing the jack terminal 35 therethrough is formed from the front portion 31 to the rear portion 32. In this case, a plurality of through-holes 33 are arranged at predetermined intervals in the lateral direction and in a row in the height direction. The intermediate portions of the jack terminals 35 excluding the elastic contact portions 36 are secured by the respective through-holes 33 and the elastic contact portions 36 are exposed to the outside from an opening (not shown) on the front end side of the front portion 31. The bent front end portions next to the elastic contact portions 36 are latched by the edge portions of the opening. The external directly-attached type terminal portions 37 of the jack terminals 35 are drawn from the rear portion 32 and connected to the wiring conductor of the circuit board 75 (see FIG. 1).

The plug 40 will subsequently be described. The plug 40 is another connecting part forming the USB connector 10.

Figure 3A:
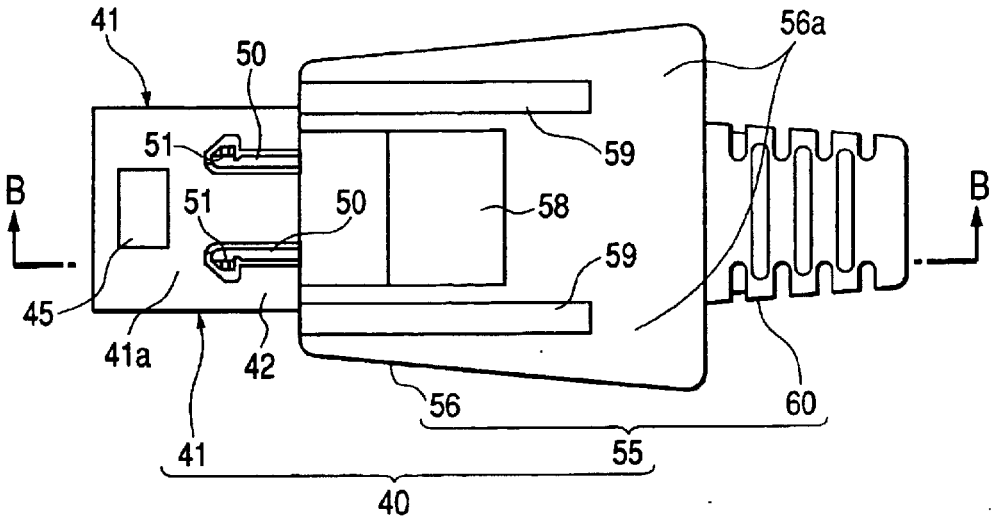
FIGS. 3A, 3B, and 3C show a diagram of a plug for use in forming the USB connector of FIG. 1.
Figure 3B:
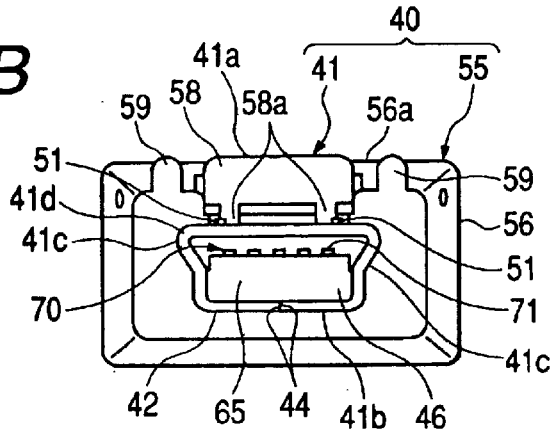
Figure 3C:
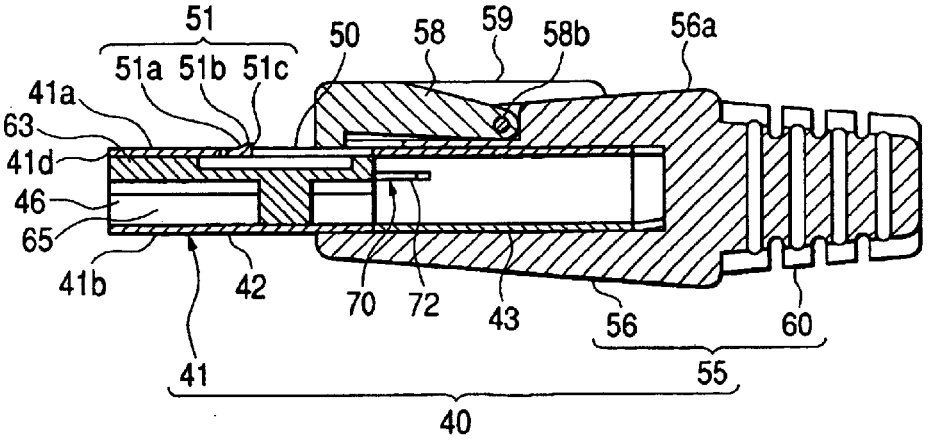

As shown in FIG. 3, the plug 40 has a plastic housing 55 and the shield case 41 held in the housing 55. A terminal holding portion 63 (see FIG. 3C) fixed to plug terminals 70 is arranged inside the shield case 41. Flexible pieces 50 are provided to the shield case 41, and a push member 58 and ribs (protruded portions) 59 are provided in the housing 55. Like the shield shell 16, the shield case 41 is formed by punching from a conductive sheet of conductive metal and bending the punched part. Like the plastic portion 30 (see FIG. 2C), the housing 55 is an insulating molded part and made of synthetic resin.

The shield case 41 is cylindrical in shape and formed with an upper wall 41*a*, a base wall 41*b* (see FIG. 3B) and side walls 41*c* (see FIG. 3B) for linking edge portions of the upper wall 41*a* and the base wall 41*b* together. A front wall 41*d* (see FIG. 3B) and a rear wall are formed in a pass-through condition. The shield case 41 has as shown in FIG. 3C a mating portion 42 as the first half portion and a base portion 43 as the second half portion in the longer direction Z.

The base portion 43 is buried inside the housing 55. The base portion 43 is extended until it reaches the rear end portion of the housing 55 and an electrical-wire connecting portion 72 as the rear end portion of each plug terminal 70 is protected in a shielded condition.

As shown in FIG. 3A, the upper wall 41*a* of the mating portion 42 is formed with a depression 45 positioned close to the opening end and the flexible pieces 50 positioned close to both side walls 41*c* (see FIG. 3B) in the rear of the depression 45. The depression 45 is a hole made by punching from a conductive sheet and formed into what dimensionally mates with the curved portion 18*c* of the tongue piece 18 formed beneath the shield shell 16. Each flexible piece 50 is slender in shape so as to be flexible and extended in the longer direction Z of the shield case 41. The base of the flexible piece 50 is linked with the upper wall 41*a* of the base portion. Each claw 51 protruding outside the upper wall 41*a* is formed at the front end of the flexible piece 50. The claws 51 are mated with the respective grooves 20 (see FIG. 2A) of the shield shell 16.

As shown in FIG. 3C, the claw 51 has a inclined plane 51*a* that is positioned on its front end side and inclined gradually backward in the longer direction Z, a communicating plane 51*b* linked with the inclined plane 51*a* and extending in parallel to the longer direction Z and a vertical latching plane 51*c* substantially vertically crossing the communicating plane 51*b*. The formation of the inclined plane 51*a* is intended to smoothly insert the shield case 41 into the shield shell 16 (see FIG. 1) without catching. The formation of the vertical latching plane 51*c* is to ensure that the jack 15 (see FIG. 1) and the plug 40 are latched together by improving the engagement of the claws 51 with the grooves 20.

As shown in FIG. 3B, the base wall 41*b* of the mating portion 42 is such that like the base wall 16*b* of the shield shell 16, both end portions 44 and 44 of the bent conductive sheet are butted against each other and the barrel portions (not shown) are meshed together before being integrally pressed.

The opening 46 in the front wall 41*d* is, like the opening 23 of the shield shell 16, arranged so that the width of the lower half portion is smaller than that of the upper half portion so as to prevent any erroneous fitting. In case where proper fitting is made possible even though the directions of the shield shell 16 and the shield case 41 are vertically turned upside down, the jack terminals 35 and the plug terminals 70 are prevented from being deformed or damaged.

As shown in FIG. 3A, the housing 55 is formed integrally with a housing body 56 and a tube 60 for use in drawing the electrical wire 74 (see FIG. 1) outside. An internal space for receiving the base portion 43 (see FIG. 3C) of the shield case 41 is formed in the housing body 56 and an internal space for passing the electrical wire 74 therethrough is formed in the tube 60 in a manner communicating with the internal space for receiving the base portion 43.

The push member 58 having projections 58*a* (see FIG. 3B) in its lower portion and the ribs 59 positioned on both side of the push member 58 and extending in the longer direction are formed on the upper wall 56*a* of the housing body 56. The push member 58 is a member for releasing the latching of the plug 40 from the jack 15; more specifically, a member for drawing the claws 51 formed in the front end portions of the flexible pieces 50 out of the grooves 20 (see FIG. 1) of the shield shell 16. The push member 58 is coupled via hinges 58*b* (see FIG. 3C) to the housing body 56. The projections 58*a* are provided opposite to each other above the pair of flexible pieces 50. Each push member 58 is pivotable with the hinge 58*b* as a fulcrum and by pivoting the push members 58 in a direction approaching the upper wall 41*a* of the shield case 41 and pressing the flexible pieces 50 with the projections 58*a*, the latching of the plug 40 is released from the jack 15.

Both the ribs 59 are provided so as to protect the push member 58 from being pushed down when the push member 58 inadvertently interferes with the outside. The front ends of the ribs 59 conform to the front end of the push member 58 and the rear ends of the ribs 59 are extended backward beyond the rear end of the push member 58. The projected height of the ribs 59 from the upper wall 56*a* is set equal to or greater than that of the push member 58 (see FIG. 3C). This is because the push member 58 cannot be protected from external interference in case that the projected height of the ribs 59 is less than that of the push member 58.

As shown in FIG. 3C, the terminal holding portion 63 is a plastic member for fixedly holding the plug terminals 70 and formed on the rear side of the upper wall 41*a* inside the shield case 41. The plurality of plug terminals 70 are fixedly lined up in a position corresponding to the elastic contact portions 36 (see FIG. 2C) of the jack terminals 35. The internal space between the terminal holding portion 63 and the lower half of the shield case 41 is used as the insertion space 65 for allowing the plastic portion of the jack 15 to be fitted in.

Each plug terminal 70 is extended straightly in the longer direction and as described above an electrical contact portion 71 (see FIG. 3B) for making contact with the elastic contact portion 36 of the jack terminal 35 is formed in one side end portion of the plug terminal 70, whereas the electrical-wire connecting portion 72 is formed in the other side end portion thereof. The electrical wire 74 (see FIG. 1) may be connected to the electrical-wire connecting portion 72 by contact bonding, pressure welding, solvent welding or the like.

Figure 4A:
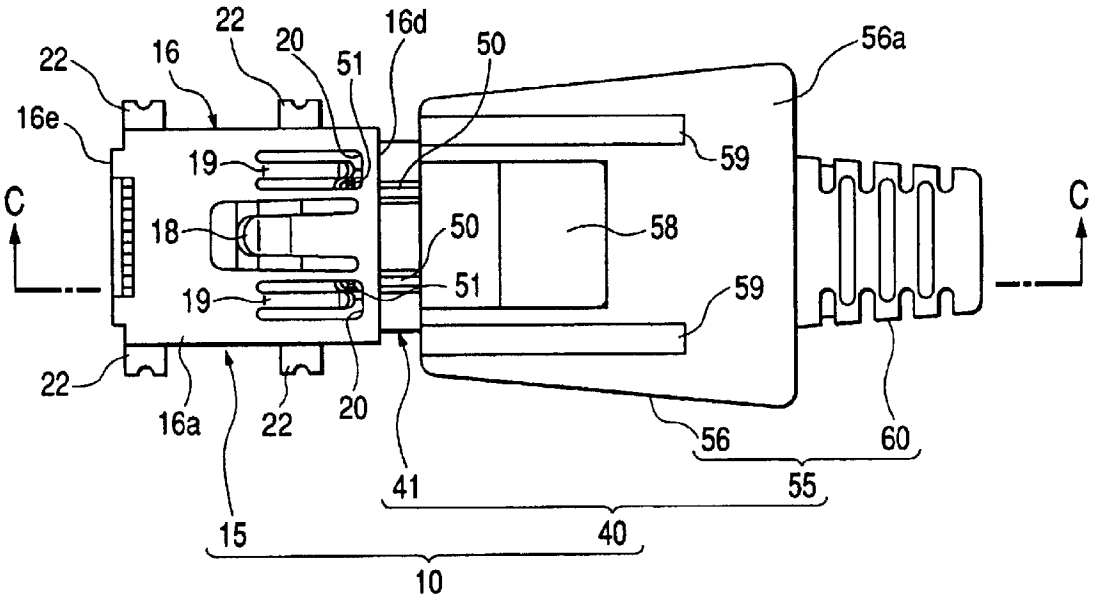
FIGS. 4A and 4B show a diagram showing the USB connector with the jack and the plug connected together.
Figure 4B:
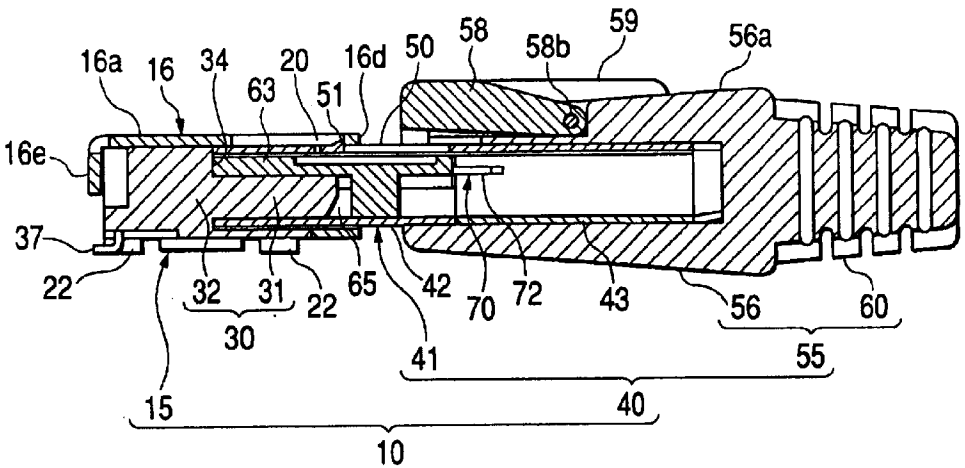
Figure 5:
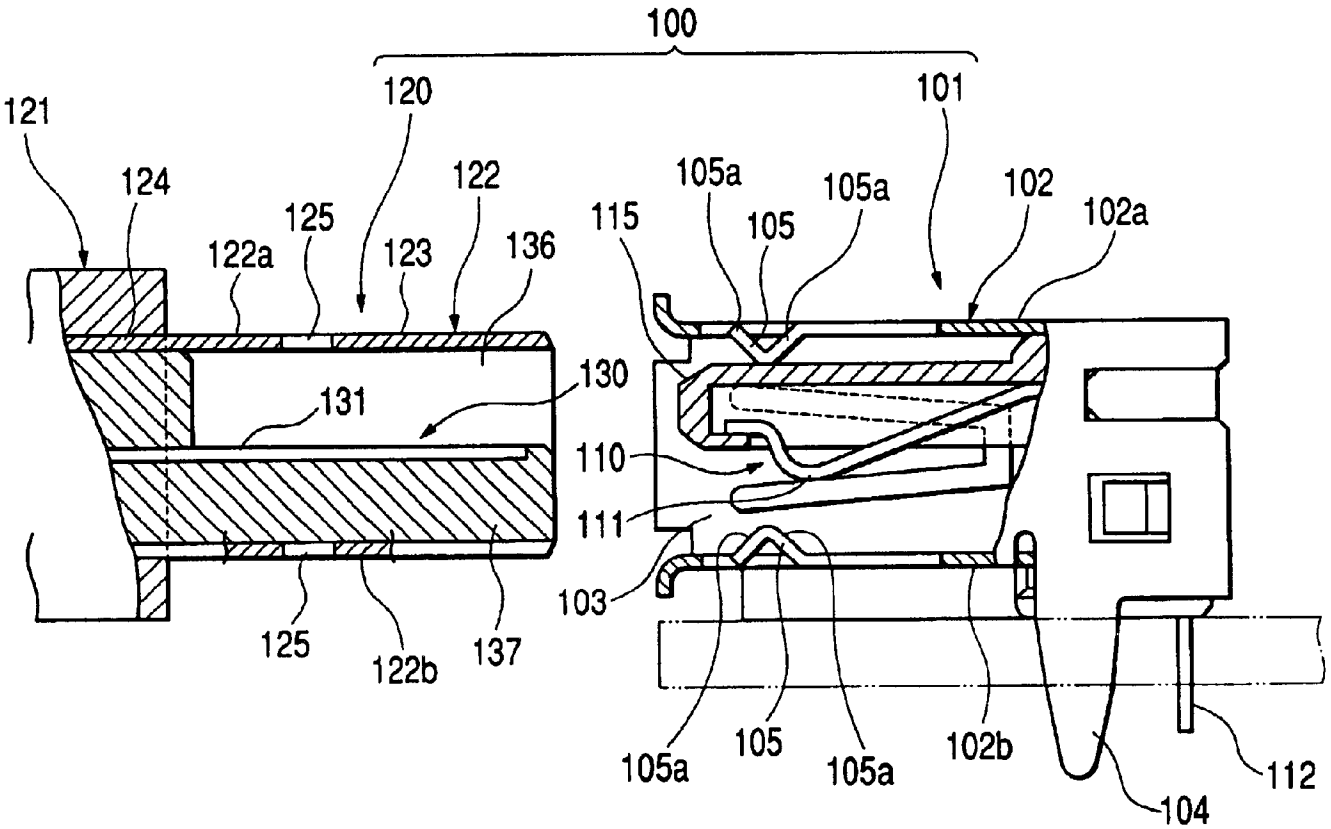
FIG. 5 shows a sectional view of a related USB connector.

Subsequently, the USB connector 10 with the jack 15 and the plug 40 connected together will be described by reference to FIG. 4.

When the shield case 41 is fitted into the mating space 25 (see FIG. 2C) of the shield shell 16 with the jack 15 and the plug 40 set opposite to each other, the inner wall face of the shield shell 16 is guided and supported by the outer wall face of the shield case 41. Then the plastic portion 30 (see FIG. 4B) of the shield shell 16 is caused to enter the insertion space 65 (see FIG. 4B) of the shield case 41 in a well-balanced condition and the elastic contact portions 36 (see FIG. 2C) of the jack terminals 35 are brought into contact with the electrical contact portions 71 (see FIG. 3B) of the plug terminal 70. The front end portion of the terminal holding portion 63 (see FIG. 4B) is brought into contact with the stopper wall 34 of the plastic portion 30 and positioned in the longer direction Z, so that the jack 15 and the plug 40 are fitted together.

The latching of the USB connector 10 will be described. When the shield case 41 is fitted into the mating space 25 of the shield shell 16, the front wall 16*d* of the shield shell 16 runs onto the inclined planes 51 (see FIG. 3C) of the claws 51 formed at the front ends of the flexible pieces 50 first. Then the flexible pieces 50 are bent in the direction in which the latching is released. When the shield case 41 is inserted further in this condition, the claws 51 proceed up to the position where the shield shell 16 faces the grooves 20 and the flexible pieces 50 return to the original state after restoring their elasticity. Further, the claws 51 and the grooves 20 mate one another and the edge portions of the grooves 20 are brought into contact with the vertical latching planes 51*c* of the claws 51, whereby the jack 15 and the plug 40 are mated together.

When the plug 40 is pulled out of the jack 15, the push member 58 is pivoted toward the upper wall 41*a* of the shield case 41 whereby to make the projections 58*a* of the push member 58 press the flexible pieces 50. Then the flexible pieces 50 are bent in the direction in which the latching is released and the claws 51 slip out of the grooves 20. With the latching released, the plug 40 is separated from the jack 15 by pulling the plug 40 backward.

As set forth above, the plug 40 can be fitted into the jack 15 with moderate strength without backlash in the vertical direction X as well as the lateral direction Y to ensure that the latching operation is performed by making the claws 51 formed on the flexible pieces 50 mate with the grooves 20. Moreover, the jack 15 and the plug 40 can easily be separated from each other by pushing the push member 58 so that the bending of the flexible pieces 50 causes the latching of the claws 51 to be released from the grooves 20.

What is claimed is:

1. A USB connector, comprising:

a jack, including;

a shield shell, having jack terminals therein; and a plug, including;

a shield case, having plug terminals to be electrically connected to the jack terminals, and fitted into the shield shell, wherein a latching portion is provided on the shield case;

wherein a shield contact piece for making contact with the shield case is provided on the shield shell by forming a groove on a wall portion of the shield shell; and wherein the latching portion engages with an edge portion of the groove formed on a mating portion when the shield case is inserted into the shield shell.

2. The USB connector as set forth in claim 1, wherein the shield contact piece is a pair of shield contact pieces; and wherein the groove is a pair of grooves.

3. The USB connector as set forth in claim 1, wherein the latching portion is a deformable piece having a claw at the front end, and the deformable piece being provided in the shield case and extending in a direction in which the plug is inserted into the jack.

4. The USB connector as set forth in claim 3, wherein the deformable piece is a pair of deformable pieces.

5. The USB connector as set forth in claim 1, further comprising a housing which holds the shield case therein; and a push member, which is pivotably coupled to the housing, and having a projection which is brought into contact with the latching portion to release the engagement between the shield shell and the shield case.

6. The USB connector as set forth in claim 5, wherein ribs positioned on both sides of the push member are provided on the housing, wherein a height of the ribs protruded outward is equal to or greater than that of the push member.

* * * * *